US005598665A

United States Patent [19]

Guddas

[11] Patent Number: 5,598,665

[45] Date of Patent: Feb. 4, 1997

[54] SLIDING SASH FOR OPTIONAL CLOSING, IN PARTICULAR FOR AN OPEN SIDE OF BALCONIES, SUN PORCHES AND THE LIKE

[76] Inventor: Juergen Guddas, Contrescarpe 65, 28195 Bremen, Germany

[21] Appl. No.: 540,049

[22] Filed: Oct. 6, 1995

[30] Foreign Application Priority Data

Oct. 6, 1994 [DE] Germany ..... 44 35 641.2

[51] Int. Cl.[6] ..... E05D 15/06

[52] U.S. Cl. ..... 49/404; 49/40; 49/411; 49/425; 49/449

[58] Field of Search ..... 49/411, 410, 409, 49/40, 404, 425, 449, 468

[56] References Cited

U.S. PATENT DOCUMENTS

| | | | |
|---|---|---|---|
| 3,199,155 | 8/1965 | Coleman | 49/409 X |
| 3,261,129 | 7/1966 | Brydolf et al. | 49/411 |
| 4,453,346 | 6/1984 | Powell et al. | 49/411 X |
| 4,833,829 | 5/1989 | Wilson | 49/425 X |
| 4,987,638 | 1/1991 | Ribaudo | 49/409 X |
| 5,148,630 | 9/1992 | Llorens | 49/425 |
| 5,209,018 | 5/1993 | Heinrich | 49/449 |
| 5,224,297 | 7/1993 | Watkins | 49/411 X |

*Primary Examiner*—Philip C. Kannan

*Attorney, Agent, or Firm*—McAulay Fisher Nissen Goldberg & Kiel, LLP

[57] ABSTRACT

The sliding sash is supported at a guide rail by a sash portion projecting from the floor in a vertical plane and a sash portion ascending in an inclined plane relative to the inside adjoins an additional tipper sash portion which projects up in the vertical plane and is set back. Every sash portion is formed by a section bar arm receiving a glass pane. The upper sash portion is guided at a ceiling rail with two running paths which are arranged at a distance from one another and parallel to one another. In order to secure this guide relative to loading by wind and/or snow, each running path is formed of two inclined guide paths of a web head of the ceiling rail, this web head having a triangular cross section, and support rollers which are supported at an inclination run on the guide paths of every web head at a roller holder which is fastened to the terminating section bar of the upper sash portion.

13 Claims, 4 Drawing Sheets

SLIDING SASH FOR OPTIONAL CLOSING, IN PARTICULAR FOR AN OPEN SIDE OF BALCONIES, SUN PORCHES AND THE LIKE

BACKGROUND OF THE INVENTION

1. Filed of the Invention

The invention is directed to a sliding sash for optional closing, in particular, for an open side of balconies, sun porches or the like, wherein every sash is supported at a floor guide rail by a sash portion projecting from the floor in a vertical plane and a sash portion ascending in an inclined plane relative to the inside adjoins an additional upper sash portion which projects up in the vertical plane and is set back, wherein every sash portion is formed by a section bar frame receiving a filling plate of glass, plastic or the like, and the upper sash portion is guided at a ceiling rail with two running paths which are arranged at a distance from one another and parallel to one another.

2. Description of the Related Art

Sliding sashes of this kind are used to close the open sides of balconies, sun porches or the like, especially those in which the ceiling is set back from the floor of the balcony or sun porch so that the sliding sashes cannot run along from the ceiling to the floor in a plane, but rather are set back toward the top to ensure a ceiling connection. Such sliding sashes can be supported and guided on a rail on the floor by means of rollers, while the upper portion of such a sliding sash is guided in a rail at the ceiling at lateral running paths by means of rollers which rotate around vertical axes. Dirt or objects lying on the floor rail can sometimes cause the floor-side rollers of the sliding sash to slip out of their guide, which in the worst cases can cause the sliding sashes to slip out of their floor guide rail so that the upper lateral guide rollers also leave the guide rail on the ceiling and the entire sliding sash ultimately tips over.

OBJECT AND SUMMARY OF THE INVENTION

The object of the present invention is to improve sliding sashes of the type mentioned above so as to enable a reliable guidance and support of the sliding sashes. This primary object is met, according to the invention, in that every running path is formed of two inclined guide paths of a web head of the ceiling rail, this web head having a triangular cross section, and support rollers which are supported at an inclination run on the guide paths of every web head at a roller holder which is fastened to the profile or section bar frame of the upper sash portion. The support rollers which are arranged in pairs in an inclined manner engage behind the web head of the running path to achieve a suspension of the sliding sashes so that the sliding sashes are reliably held in a guided manner on the one hand and the sliding sash is prevented from slipping out of its running path on the other hand.

According to a design feature of the invention, for the purpose of achieving a quiet running on the one hand and a low-resistance displacing movement of the sliding sashes on the other hand, the support rollers are formed of rolling bearings whose outer ring preferably has a coating of plastic. For this purpose, the support rollers are supported on spindle pins which are riveted to inclined legs of the roller holder for arranging the support rollers in pairs.

To facilitate mounting, the guide rail is divided along its length so that the sliding sashes can be hung after mounting one half of the guide rail. The web heads of the ceiling rail have centering grooves extending in the longitudinal direction of the section so that the second half of the guide rails can then also be mounted so as to be exactly aligned. Heavy-duty dowel pins can be inserted in the dividing region of these centering grooves so that the web heads of the ceiling rails are exactly aligned with one another so as to prevent offsetting in the running path of the sliding sashes.

In order to achieve a reliable guidance of the lower sash portion of the sliding sashes, guide rollers which engage via a flange in a guide groove in the floor guide rail are supported in the lower section bar of the section bar frame of the lower sash portion. The insertion of the flange in the guide groove of the floor rail can be facilitated in that the side cheeks of the flange taper from the outer surface of the roller to its outer circumference. In this way, a flange having a trapezoidal cross section is formed, the narrow side of this flange penetrating easily into the guide groove of the floor guide rail. Further, the running noise is substantially reduced by the inclined surfaces of the flange. These guide rollers are supported in a roller cage which can be slid into the lower section bar of the floor sash portion and secured therein, so that tolerances in the lower guide rollers with respect to their height can be compensated.

In order to enable a secure connection of the lower section bar to the lateral frame section bars on the one hand and to protect the sliding sash from lifting out of the lower guide groove on the other hand, the lower section bar of the lower sash portion also has a threaded slot for a frame connecting screw, this threaded slot being enclosed by an elongated hole of a retaining plate engaging in the undercut guide groove of the floor guide rail by a hammerhead or T-head.

A plastic part can also be used instead of a retaining plate so as to prevent sliding noises during the displacing movement. A retaining slide of this type which is made of plastic, e.g., glass-fiber-reinforced polyamide, may be slid via a shaft part into the side frame part which is open at the end, specifically in such a way that it is guided therein so as to be fixed with respect to relative rotation and projects out of the side frame part by its base part. The base part has two retaining fingers which project downward and engage in the guide groove of the floor guide rail and have cam shoulders which face away from one another and prevent the retaining fingers from being pulled out of the guide groove from above.

The upper sash portion extending in a vertical plane and the lower sash portion also extending in the vertical direction can be bridged by angular frame section bars, the inclined sash portion being formed therebetween. However, for this purpose it is necessary to adapt the angular frame section bars to the desired inclined position of the middle sash portion. However, in order to dispense with such angular frame section bars and achieve any optional inclined position, a horizontally extending pipe fitted to the side frame parts is arranged in each instance between the lower, vertically projecting sash portion and the sash portion arranged in the inclined plane on the one hand and between the inclined sash portion and the upper, vertically projecting sash portion on the other hand, frame section bars for holding the filling plates being arranged at this horizontally extending pipe. These frame section bars are preferably screwed to the pipes with the intermediary of a seal.

In order to secure the sliding sash in the closed position once it has been moved into this position and to prevent displacement due, for example, to the effect of wind in particular, the inner sliding sash is advantageously outfitted with a locking device which can be actuated to secure the closing position between the inner sliding sash and the outer sliding sash. For this purpose, a sleeve having a space for receiving a spring is secured in the vertical section bar of the inner sliding sash and is penetrated by an inner locking pin at which is fastened a handle facing the interior, wherein the locking pin which projects out of the sleeve by a pin part projects into a locking recess in the outer sliding sash under the influence of a closing spring.

In order that the running path of the ceiling rail is exactly parallel to that of the floor guide rail, the floor guide rail is formed by a lower U-section bar and an upper U-section bar which engages over the latter and contains the guide grooves. For this purpose, the lower U-section bar has projection pairs with screw grooves which face one another and in which stud screws can be screwed to support the upper U-section bar in an adjustable manner. The invention is shown in an embodiment example in the drawing and is explained more fully in the following.

DESCRIPTION OF THE PREFERRED EMBODIMENTS

Figure 1:
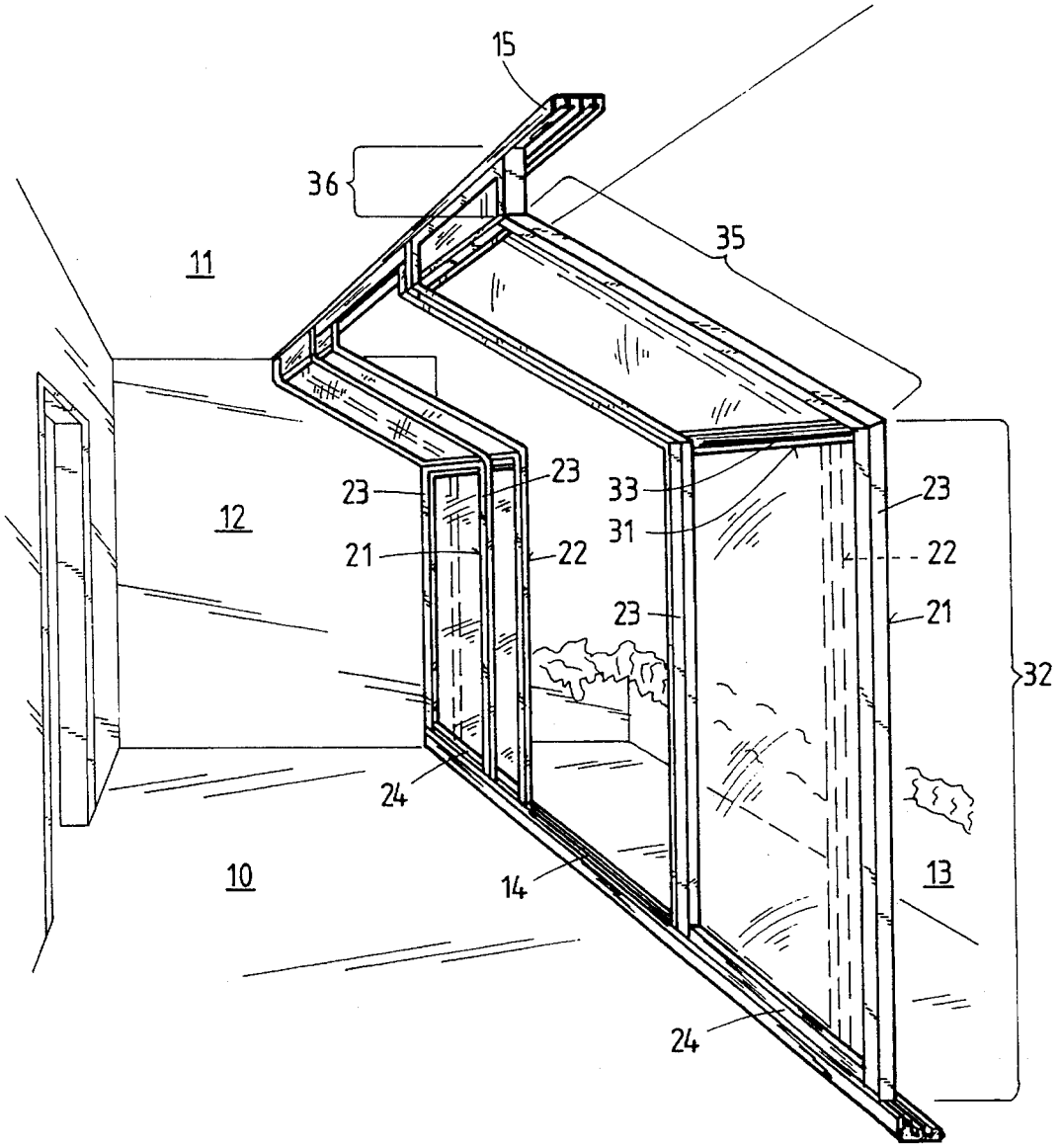
FIG. 1 illustrates in a perspective view as seen from the inside, four sliding sashes for closing the open side of a balcony which are slid one behind the other in pairs to form a through-opening.

FIG. 1 shows a balcony in which the floor 10 is set out from the ceiling 11. The balcony which is bordered by the floor 10, ceiling 11, and two side walls 12 opens toward the outside and is protected by a balustrade 13. A guide rail 14 attached to the floor 10 is located between the two side walls 12 just before the outer front end of the balustrade 13, while a rail 15 which is set back relative to the rail 14 but which extends parallel to the floor guide rail 14 is also attached to the ceiling 11 at a short distance from its outer front end. The ceiling rail 15 is constructed as a box which opens downward and has two channels 16 extending adjacent to one another. Each channel 16 is divided by a downwardly projecting web 17 having at its free end a triangular web head 18 which forms a running path 19 in the longitudinal direction of the section. This running path 19 is formed of two guide paths 20 which are inclined owing to the triangular shape of the web head 18 and whose purpose will be described in the following.

The floor guide rail 14 and the ceiling rail 15 serve to hold at least two sliding sashes 21 and 22 which are displaceable one behind the other. Each sliding sash has two sash planes which are offset relative to one another and are connected with one another by an inclined sash portion. Each sliding sash 21, 22 has two side frame parts 23 comprising a section bar to form a Z shape, these side frame parts 23 being connected with one another by intermediately arranged section bars. A narrow section bar 24 which is connected with the side frame part 23 in a stationary manner by means of screws 25 which are screwed into a threaded slot 51 of section bar 24 is inserted between the side frame parts 23 in the region of the floor guide rail 14. At its lower side, this section bar 24 has a space for receiving guide rollers 26 which are supported in turn in a roller cage 27 and are inserted in the hollow space of the section bar 24 as can be seen from FIG. 4.

Figure 3:
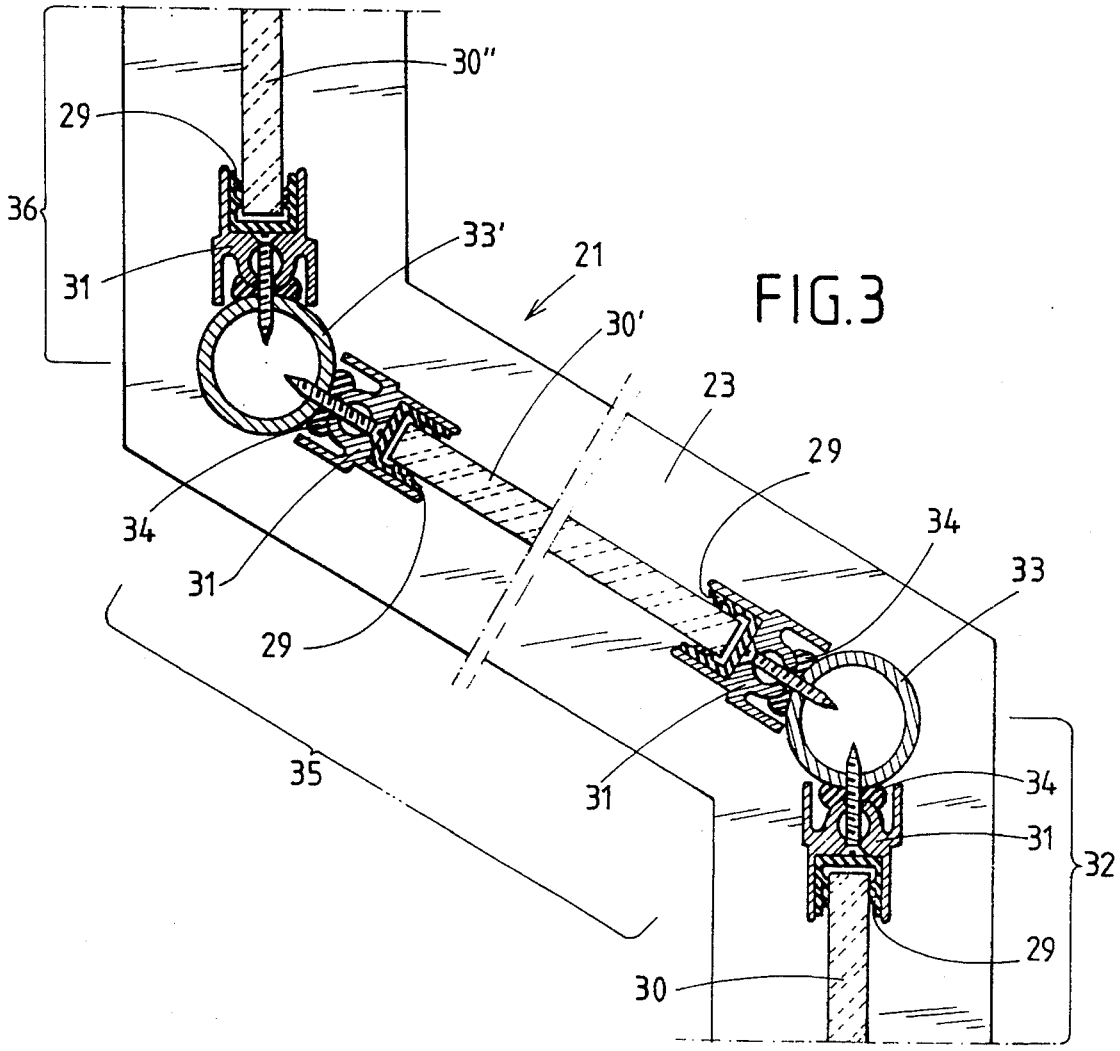
FIG. 3 illustrates the central part of a sliding sash whose inclined sash portion adjoins the upper sash portion and lower sash portion, also in vertical section.

Above the receiving space for the guide rollers 26, the section bar 24 has a groove 28 in which a filling plate 30 is inserted with the intermediary of a seal 29, this filling plate 30 likewise engaging in grooves of the side frame parts 23 in an identical manner. Together with the section bar 24, a frame section bar 31, and the filling plate 30, the side frame parts 23 projecting in the vertical direction from the floor guide rail 14 form a sash portion 32 which forms a vertical partial plane of each sliding sash 21 and 22, respectively. At the end of this sash portion 32, a pipe 33 is attached between the side frame parts 23, the frame section bar 31 being screwed to this pipe 23 with the intermediary of a seal 34 (FIG. 3). Adjoining the lower sash portion 32 is another sash portion 35 which is inclined and is likewise bordered by a pipe 33' which interconnects the side frame parts 23. Frame section bars 31 are connected by screws, also with the intermediary of a seal 34, to the pipes 33 and 33' in accordance with the receiving groove in the side frame parts 23. As a result of the double-T-shaped cross section of the frame section bars 31, a groove is also formed around the circumference in the central sash portion 35, a filling plate 30' being inserted into this groove with the intermediary of a seal 29. An upper sash portion 36 which extends in the vertical plane adjoins the sash portion 35 and is connected at the bottom to the pipe 33' by a frame section bar 31, while the upper sash portion 36 is defined at the top by a terminating section bar 37 whose width matches that of the side frame part 23. The terminating section bar 37 also has a threaded slot 38 by means of which the terminating section bar 37 can be screwed between the side frame parts 23. In its central region, the terminating section bar 37 likewise has a downwardly open groove 28 which, together with the grooves in the side frame parts and the section bars 31, serves to receive a filling plate 30" with the aid of a seal 29. The filling plates 30 to 30" are normally glass sheets, although it is also conceivable to use filling plates made of a different material such as plastic.

Figure 2:
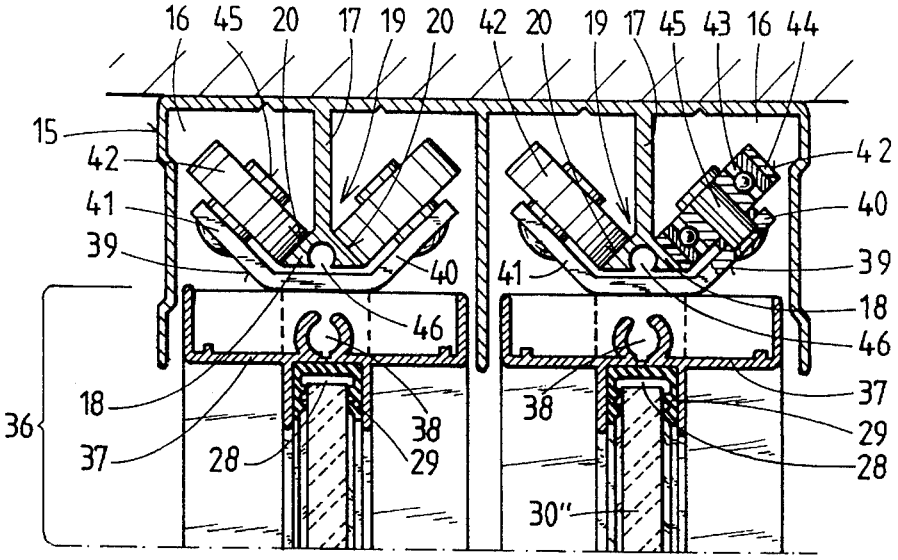
FIG. 2 illustrates the upper suspension of the sliding sashes at a ceiling rail in vertical section.

Two roller holders 39 which are arranged at a distance from one another are fitted to the terminating section bar 37 of the upper sash portion 36 of every sliding sash 21, 22, support rollers 42 being supported at the inclined legs 40 and 41 of the roller holders 39 in such a way that their outer circumference contacts the guide paths 20 of each web head 18 so as to be flush with the latter. As will be seen especially from FIG. 2, the support rollers in the present embodiment example are formed of rolling bearings 43 whose outer ring has a coating 44 preferably of plastic. The inner ring of each rolling bearing 43 forming the support roller 42 is supported on a spindle pin 45 which is constructed as a collar bolt and which is riveted in the leg 40 and 41 of each roller holder 39 after the respective support roller 42 and a spacer ring have been fitted. The pairs of support rollers of a roller holder 39 which are inclined relative to one another, two of these pairs of support rollers being fitted at a distance from one another one behind the other at the terminating section bar 37, enable a self-centering of the sliding sashes 21 and 22 at the web head 18 of the ceiling rail 15 even when the sliding sashes are loaded by wind or snow, so that the sliding sash cannot tilt. In order to achieve aligned running paths 19 even when two or more ceiling rails 15 are arranged one behind the other, the web heads 18 of the webs 17 of the ceiling guide rail 15 are provided with longitudinally extending centering grooves 46, heavy-type dowel pins, not shown, being inserted into these centering grooves 46 in the region where they abut with the ceiling rail 15.

Roller cages 27 with guide rollers 26 supported therein are inserted in the section bar 24 of the lower sash portion 32. These guide rollers 26 have a flange 47 which engages in a guide groove 48 of the floor guide rail 14. The two side cheeks 49 of the flange 47 taper from the outer surface 50 of the roller to the outer circumference of the flange 47 to ensure a reliable insertion of the flange 47 in the guide groove 48 of the floor guide rail 14. In order to produce a reliable connection between the section bar 24 and the side frame part 23 of the lower sash portion 32, a threaded slot 51 extending in the longitudinal direction is provided at the lower section bar 24. A screw 25 which penetrates the frame side part 23 can be screwed into this threaded slot 51 to connect the frames. On the other hand, in the construction shown in FIG. 4, this screw 25 also serves to hold securing means preventing the sliding sashes from lifting out of the guide groove 48. For this purpose, the shank of the screw 25 is enclosed by the elongated hole 53 of a retaining plate 52 having, at its lower end, a T-head 54 which engages in the undercut guide groove 48 of the floor guide rail 14.

A retaining slide 72 can also be used instead of the lift-out protection described above and shown in FIG. 4. This retaining slide 72 can be made of plastic and has an elongated shaft part 73 with a lower base part 74. This base part 74 is provided with at least two retaining fingers 75 which project down into the guide groove 48 of the floor guide rail 14 and have, at their underside, cam shoulders 76 which project out in opposite directions and which are placed in the guide grooves 48.

Figure 4:
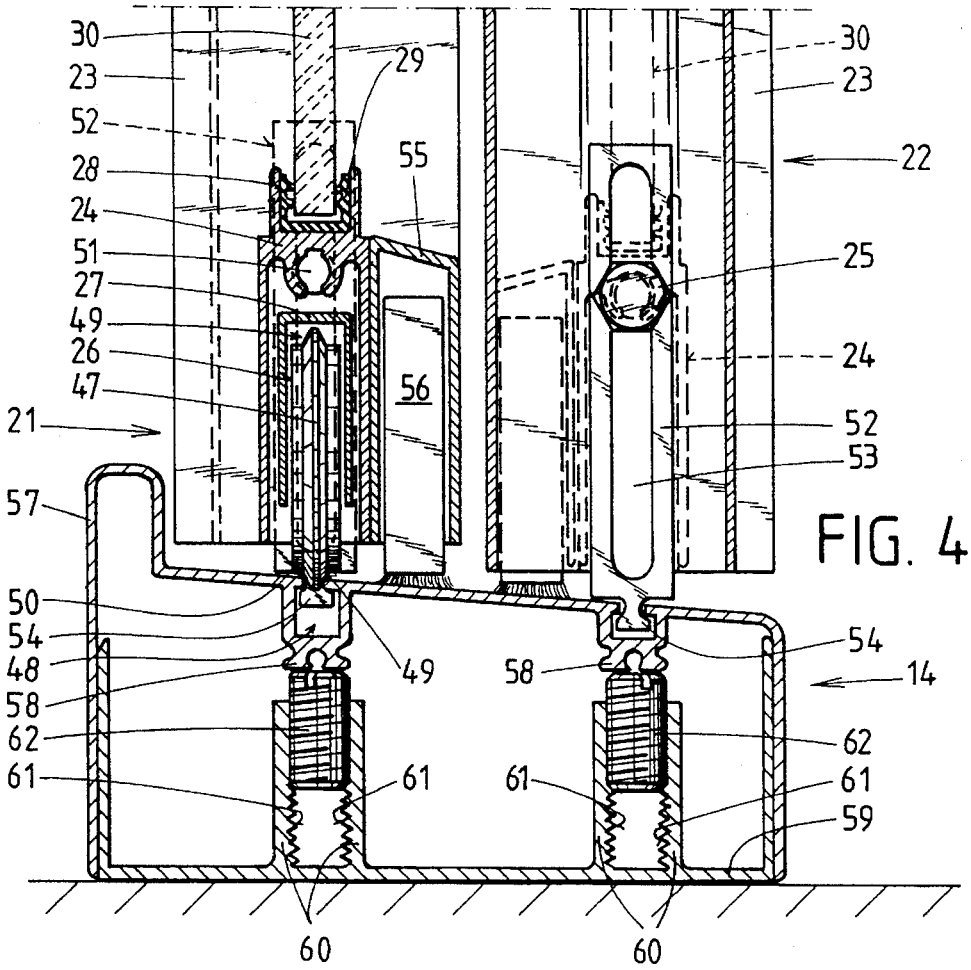
FIG. 4 shows the lower region of two sliding sashes which are arranged side by side and are guided on a floor rail, also in vertical section.
Figure 6:
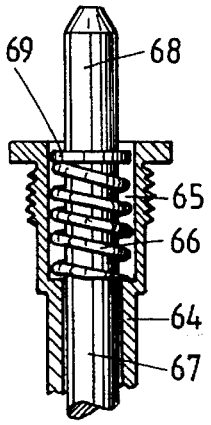
FIG. 6 shows detail VI from FIG. 5 showing the locking device in horizontal section.

As will be seen especially from FIG. 4, the inner sides of the section bars 24 of the sliding sashes 21 and 22 facing one another are connected with a downward opening U-shaped receiving section 55 which receives a sealing strip 56 whose brush-like underside rests on the surface of the floor guide rail 14 by the force of the gravity and accordingly prevents drafts. To enable adjustment of the guide groove 48 of the floor guide rail 14 in an exact horizontal plane, the floor guide rail 14 is formed of an upper U-section bar 57 whose underside is open and whose upper side extends at an inclination toward the outer side of the building and has the guide grooves 48 in this inclined surface. These guide grooves have contact shoulders 58 at their underside whose purpose will be described in the following. The upper U-section bar 57 engages over a lower U-section bar 59 which can be advantageously secured at the floor by its web. A pair of projections 60 which are provided with screw grooves 61 at their sides which face one another project out of the web on the inner side of this lower U-section bar. Stud screws 62 are screwed into these screw grooves 61 of each projection pair 60 and lie exactly below the contact shoulders 58, since the spacing between the projection pairs 60 corresponds to the spacing of the guide grooves 48. The above-mentioned contact shoulders 58 of the upper U-section bar 57 are supported on these stud screws 62 so that an exact horizontal position of the upper U-section bar 57 having the guide grooves 48 can be adjusted by means of a corresponding level setting via the stud screws 62.

Figure 5:
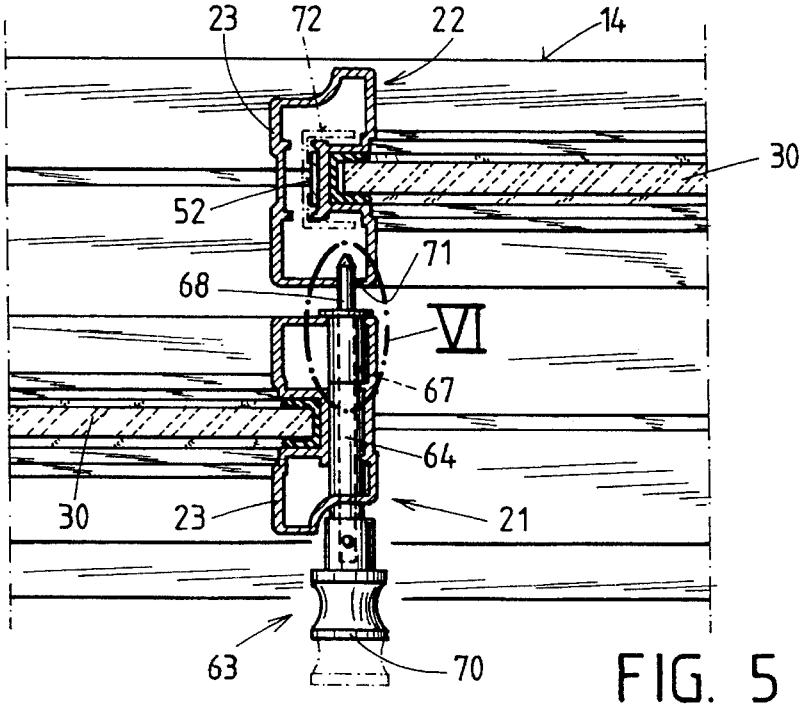
FIG. 5 illustrates the frame parts of two sliding sashes moved into the closed position which is secured by a locking device, which frame parts are arranged one behind the other, wherein the vertical frame parts of the sliding sashes are shown in horizontal section.
Figure 7:
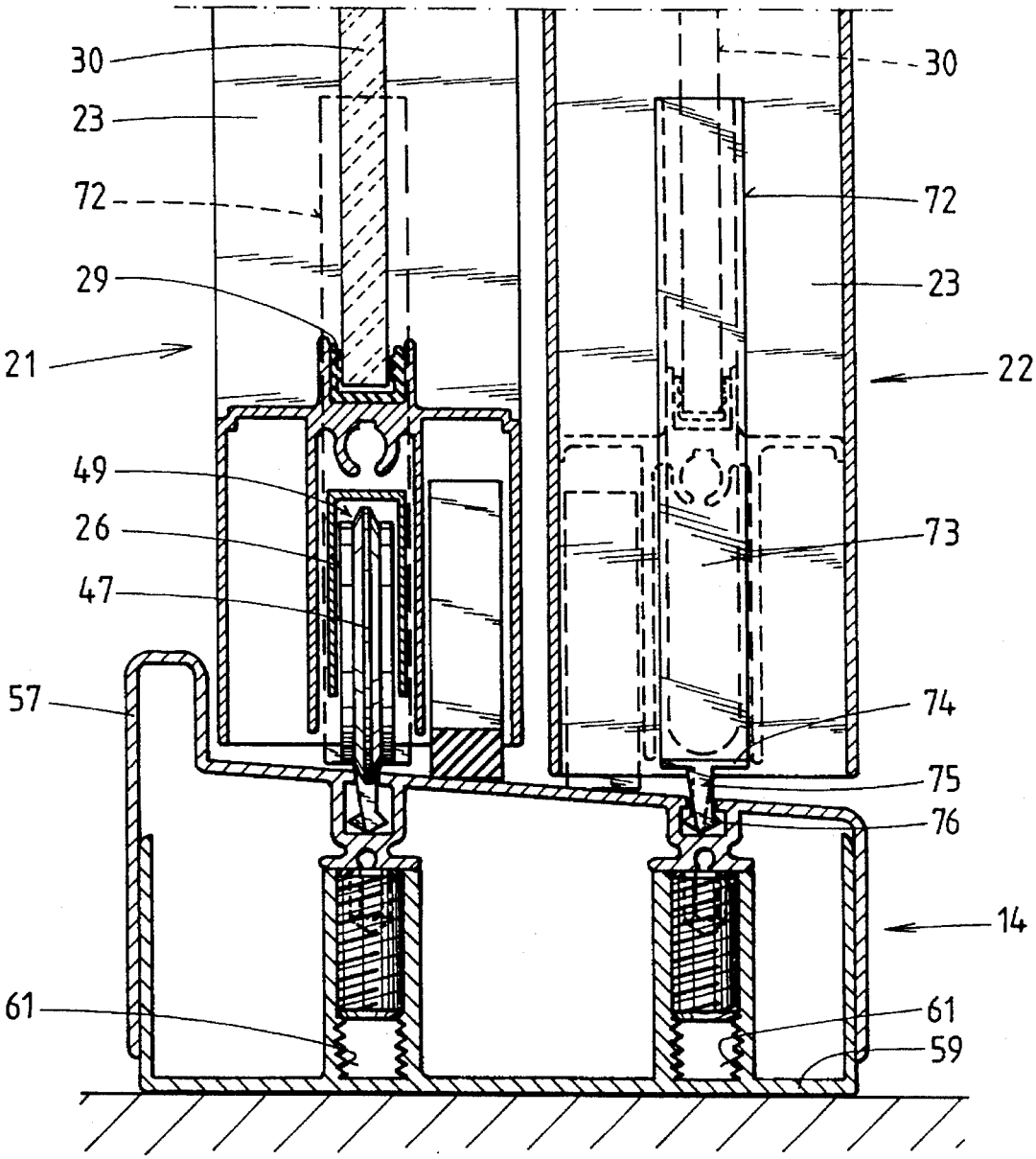
FIG. 7 illustrates an alternative embodiment form of the lower sliding sash region in a view analogous to FIG. 4.

The inner sliding sash is outfitted with a locking device 63 which can be actuated to secure the closed position of the two sliding sashes relative to one another. For this purpose, a sleeve 64 is secured, e.g., by screwing, in the vertical section bar of the side frame part 23 at the inner sliding sash 21. This sleeve 64 has a spring receiving space 65 which is stepped relative to the sleeve 64 and has a contact face for a one-sided support of a closing spring 66. The sleeve 64 and the closing spring 66 are penetrated by a locking pin 67 which can project out of the sleeve 64 by a pin part 68. A stationary shoulder 69 between the pin part 68 and the shaft of the locking pin 67 provides for the support of the closing spring 66 at its other end. A handle 70 is connected with the locking pin 67 in a stationary manner at the end of the locking pin 67 located opposite the pin part 68, this handle 70 contacting the end of the sleeve 64 and accordingly defining the travel of the pin part 68 of the locking pin 67. In the locked state shown in FIG. 5, the pin part 68 of the locking pin 67 projects into a locking recess 71 in the side frame part 23 of the outer sliding sash 22. In order to displace the sliding sashes 21 and 22 relative to one another, the handle 70 is first moved into the position shown in dash-dot lines in FIG. 5 so that the pin part 68 also moves out of the locking recess 71 of the sliding sash 22 so that the sliding sashes can be displaced relative to one another.

As was already mentioned, the embodiment forms shown in the drawings and described above only represent examples of the invention which is in no way limited exclusively to these examples. Rather, there are many other possible modifications and constructions of the invention. Further, all of the new features mentioned in the description and/or shown in the drawings are substantial to the invention even when not expressly claimed in the claims.

What is claimed is:

1. A sliding sash for optional closing, in particular for closing an open side of balconies, sun porches or the like having a floor therein comprising:

a floor guide rail;

a sash portion projecting from the floor in a vertical plane and a sash portion ascending in an inclined plane relative to the inside adjoining an additional upper sash portion which projects upward in the vertical plane and is set back, said sash portions for supporting said sliding sash at said floor guide rail;

every sash portion being formed by a section bar frame receiving a filling plate of glass, plastic or the like;

said upper sash portion being guided at a ceiling rail with two running paths which are arranged at a distance from one another and parallel to one another;

every running path being formed of two inclined guide paths of a web head of the ceiling rail, said web head having a triangular cross section; and support rollers which are supported at an inclination run on the guide paths of every web head at a roller holder which is fastened to a terminating section bar of the upper sash portion.

2. The sliding sash according to claim 1, wherein the support rollers are formed of rolling bearings whose outer ring has a coating of plastic.

3. The sliding sash according to claim 1 wherein the support rollers are supported on spindle pins which are riveted to inclined legs of the roller holder.

4. The sliding sash according to claim 1, wherein the web heads of the ceiling rail have centering grooves extending in the longitudinal direction of the section.

5. The sliding sash according to claim 1, wherein guide rollers which engage via a flange in a guide groove in the floor guide rail are supported in the lower section bar of the section bar frame of the lower sash portion.

6. The sliding sash according to claim 5, wherein the side cheeks of the flange taper from the outer surface of the roller to its outer circumference.

7. The sliding sash according to claim 5, wherein the guide rollers are supported in a roller cage for being slid into the lower section bar of the floor sash portion and secured therein.

8. The sliding sash according to claim 5, wherein the lower section bar of the lower sash portion has a threaded slot for a frame connecting screw, said threaded slot being enclosed by the elongated hole of a retaining plate engaging in the undercut guide groove of the floor guide rail by a T-head.

9. The sliding sash according to claim 1, wherein a horizontally extending pipe fitted to side frame parts is arranged in each instance between the lower, vertically projecting sash portion and the sash portion arranged in the inclined plane on the one hand and between the inclined sash portion and the upper, vertically projecting sash portion on the other hand, frame section bars for holding the filling plates being arranged at this horizontally extending pipe.

10. The sliding sash according to claim 9, wherein that the frame section bars are screwed to the pipes with the intermediary of a seal.

11. The sliding sash according to claim 1, wherein an inner sliding sash is outfitted with a locking device which can be actuated to secure the closing position between the inner sliding sash and an outer sliding sash.

12. The sliding sash according to claim 11, wherein a sleeve having a spring receiving space is secured in the vertical section bar of a side frame part at the inner sliding sash, and wherein said sleeve is penetrated by a locking pin to which is fitted a handle inwardly, and wherein said locking pin projects out of said sleeve by a pin part and projects into a locking recess in said outer sliding sash under the influence of a closing spring.

13. The sliding sash according to claim 1, wherein said floor guide rail is formed by a lower U-section bar and an upper U-section bar which engages over the latter and contains the guide grooves, wherein the lower U-section bar has projection pairs with screw grooves which face one another and in which stud screws can be screwed to support the upper U-section bar in an adjustable manner.

* * * * *